US005158356A

United States Patent [19]

Guthrie

[11] Patent Number: 5,158,356

[45] Date of Patent: Oct. 27, 1992

[54] ORNAMENTAL LAMP WITH INTERNAL SWITCH

[76] Inventor: Alan V. Guthrie, 32751 SW. Laurel View Rd., Hillsboro, Oreg. 97123

[21] Appl. No.: 833,024

[22] Filed: Feb. 10, 1992

[51] Int. Cl.[5] ..... F21L 7/00

[52] U.S. Cl. ..... 362/188; 362/198; 362/200

[58] Field of Search ..... 362/188, 198, 200, 201, 362/203, 205, 208

[56] References Cited

U.S. PATENT DOCUMENTS 4,800,469 1/1989 Leon ..... 362/200 X

*Primary Examiner*—Allen M. Ostrager

*Attorney, Agent, or Firm*—James D. Givnan, Jr.

[57] ABSTRACT

The miniature light assembly disclosed includes a housing with parts defining a battery chamber and a guideway for slidably supporting a light such as a diode. A light bulb extends from the housing to permit positioning the light with the fingertips. Leads of the light straddle a disk shaped battery with one lead being isolated from battery terminal contact by a disk. A disk aperture permits entry upon positioning of the light in the housing and contact of an irregular segment of the lead with the battery terminal. Resilient pads urge the leads toward contact with the terminal surfaces of the battery. Semicircular portions of the housing confine the light for sliding movement.

9 Claims, 2 Drawing Sheets 1
2
2
14
12

2
20
13
7
16
16A
4
4A
4B
15
15A
14
17
11
12
7
6
3
5
9
20
9
8
10
9A
21
13
2

ORNAMENTAL LAMP WITH INTERNAL SWITCH

BACKGROUND OF THE INVENTION

The present invention pertains generally to miniature self-contained lights having a battery and switch component.

The use of miniature lights or lamps for various purposes is hindered by the fact that the inclusion of a switch component renders the light unit of objectionable size, weight and complexity. Attempts to install miniature lamps on articles for decorative and/or safety purposes is accordingly restricted to articles of size wherein added weight is of no significance. The use of known lighting devices for installation on kites, miniature aircraft, jewelry, clothing, toys and various small articles for special effects is accordingly limited.

U.S. Pat. No. 4,692,846 discloses a LED having a pair of leads secured to a housing for a disk or button shaped battery. The battery tips into and out of contact with the leads by fingertip pressure. U.S. Pat. No. 4,638,409 discloses a case in which a disk battery is slidably mounted for travel toward and away from a contact in circuit with a case mounted light. U.S. Pat. No. 4,408,261 discloses a light for a charm bracelet including an LED carried by a finger actuated movable cap on a battery housing with LED leads extending through the movable cap and then into a battery case for sliding contact with opposite sides of a disk shaped battery. U.S. Pat. No. 4,337,504 discloses an earring wherein an irregularly shaped lead for an LED engages one side of a battery while the end of a second lead contacts a remaining side of battery. U.S. Pat. No. 4,317,161 discloses multiple diodes for adorning the hair with a switch provided by a threaded shaft which closes a light circuit upon being rotated into a battery housing provided with contacts. U.S. Pat. No. 4,237,525 discloses an earring diode having one lead permanently attached to a disk battery with the remaining lead contactable with the negative side of the battery. An insulative plate constitutes a switch. U.S. Pat. No. 3,624,384 discloses an earring including a miniature battery and lamp. U.S. Pat. No. 3,508,041 discloses a tie clasp which includes a lamp powered by a movable disk battery having off and on positions.

SUMMARY OF THE PRESENT INVENTION

The present invention is embodied within a battery powered light assembly including a movably mounted lamp constituting part of a switch for the assembly.

The present light assembly includes a housing in which is carried a disk shaped battery and a lamp having flexible leads for selective contact with the battery. A lamp base is housed within a guideway in the housing to permit the lamp and its leads to move by fingertip pressure into and out of contact with the battery. The lamp protrudes from the housing to permit grasping of the lamp by the fingertips. One lead of the lamp is displaceable away from battery contact coincident with lamp movement in one direction and conversely, upon lamp movement in the opposite direction, the lead moves into contact with the battery to complete a circuit to the lamp. An insulative component isolates one of the lamp leads from battery contact in one lamp position. Resilient means urge that last mentioned lamp lead into contact with the battery upon repositioning of the lamp and lead to an on position.

Important objectives of the present invention include the provision of a self contained light assembly including a slidably mounted lamp positionable to ON and OFF positions relative the housing of the assembly; the provision of a self-contained light assembly having an internal switching mechanism utilizing light assembly wherein an insulative disk overlies a battery surface to isolate a lamp lead from the battery with a void formed in the insulative disk to receive a flexible lead of a lamp urged into battery contact by a resilient component.

DETAILED DESCRIPTION OF THE PREFERRED EMBODIMENTS

Figure 1:
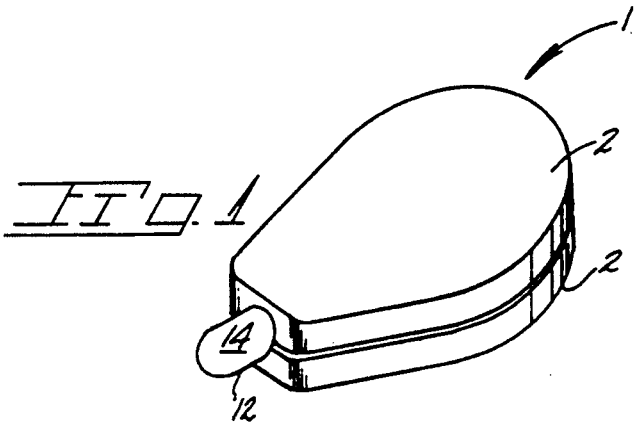
FIG. 1 is a perspective view of the present light assembly.

With continuing attention to the drawings wherein applied reference numerals indicate parts similarly hereinafter identified, the reference numeral 1 indicates generally the present light assembly.

Figure 2:
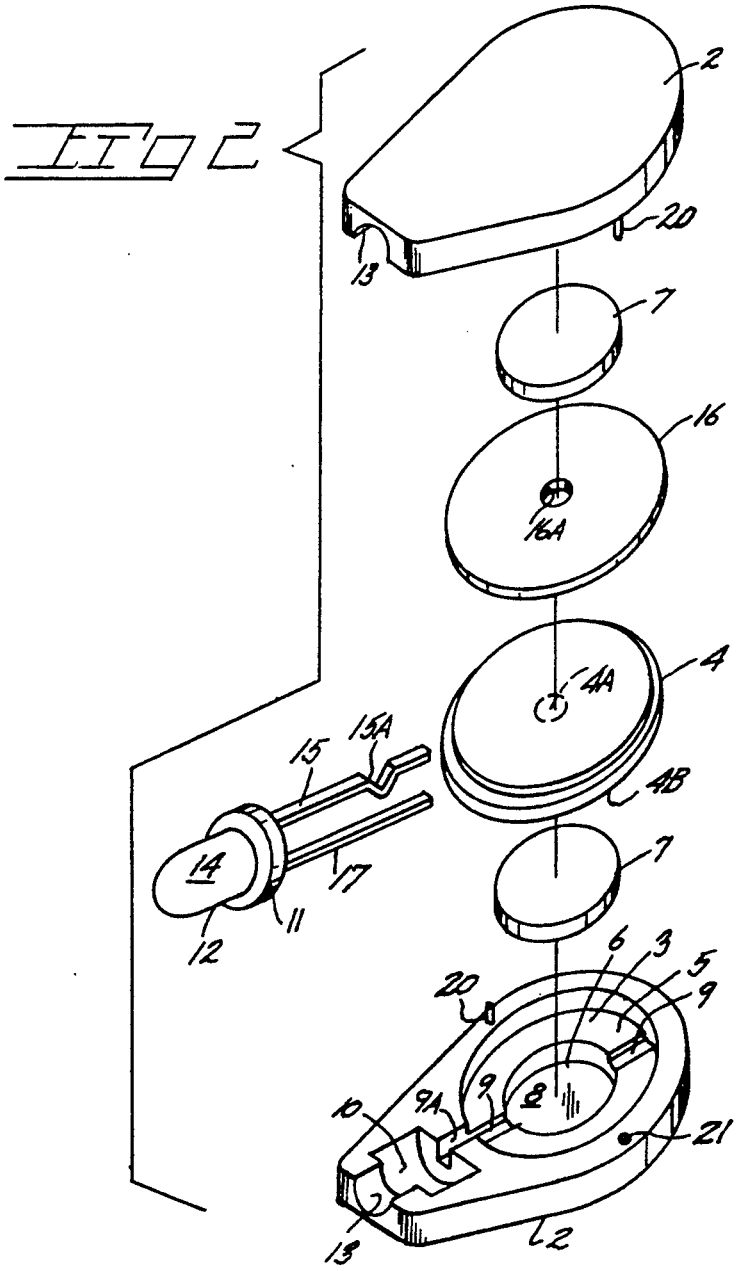
FIG. 2 is an expanded view of the assembly.
Figure 3:
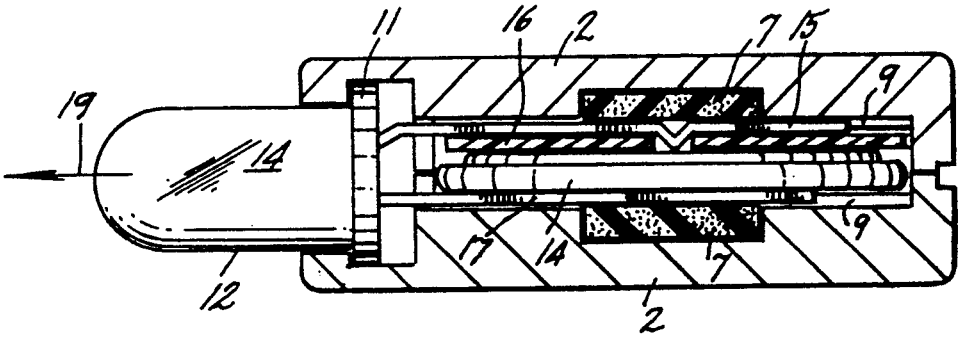
FIG. 3 is a vertical sectional view taken along line 3—3 of FIG. 1.
Figure 4:
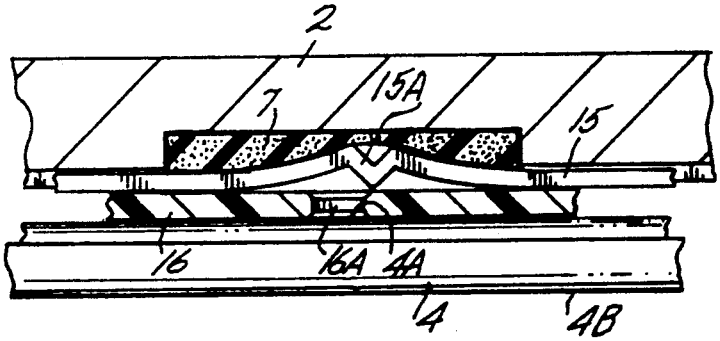
FIG. 4 is a fragmentary enlarged view of a lead displaced to an OFF position.

The light assembly includes housing members at 2 which preferably are of like construction and accordingly the following description is applicable to both. A cavity 3, as seen in FIG. 2, serves to receive a disk shaped battery at 4. The housing member has a shoulder 5 on which the battery may rest while a second cavity at 6 receives resilient means at 7 shown as a pad. A bottom housing wall is at 8. A channel 9 has segments in shoulder 5 and at 9A.

A circular guideway 10 in an assembled housing member forms a chamber in the housing to receive the circular base 11 of a lamp 12. In communication with the chamber is a semi-circular surface 13 which, when the housing halves are joined, forms a circular guide and support for the transparent bulb 14 of lamp 12.

Insulative means 16 is shown as a disk of non-conductive material, in place on one side of disk battery 4 and serves to separate an elongate, flexible lead 15, in a first or OFF position, from contacting a battery terminal surface area at 4A. A disk aperture 16A permits an irregular shaped lead segment 15A of lead 15 to make contact with battery surface 4A in a second or ON position of the light assembly. The resilient means 7 is disclosed as being pads of a resilient nature one of which bears on lead 15 to bias same at all times toward insulator means 16 and particularly to urge irregular lead portion 15A through disk aperture 16A when the light assembly is positioned outwardly in the direction of the arrow 19. Each resilient pad 7 is confined within the lesser cavity 6 of each housing member. The remaining resilient pad biases a second lead 17 in lengthwise sliding engagement with the remaining terminal of the battery.

Accordingly as the leads 15–17 slide in channels 9 and 9A in both housing parts 2 the pads 7 slidably support and urge the leads toward the battery terminal surfaces 4A and 4B. The pads may be of a synthetic foam of a durometer rating assuring contact with the battery. The bulb or illuminated end 14 of the light is of a length to protrude an adequate distance outwardly from the housing, a quarter inch or so, to permit grasping by the fingertips for outward deployment. Inward positioning of the light assembly interrupts the light circuit as irregular lead segment 15A is lifted out of battery contact by the inner edge of disk 16 defining aperture 16A.

Attachment of housing 1 to a support may include the use of interengaging closure elements such as those of the hook and loop type adhesively applied to the housing and the supporting surface. The manner of attachment will be largely determined by the particular use intended.

To assure precise assembly and registration of the two housing parts in a detachable manner pin and socket components are at 20 and 21.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A miniature assembly including, a housing having a guideway and a battery chamber for reception of a battery, a light assembly having a transparent portion protruding from the housing and slidably mounted for travel in said guideway and having elongate first and second leads oppositely disposed from a battery in said chamber, said first lead for interruptible contact with a battery terminal in said chamber, and insulative means supporting said first lead during a portion of light assembly travel to maintain the first lead out of contact with a battery in said housing, said insulative means terminating at a point along the range of travel of the first lead to permit the first lead to contact the battery terminal.

2. The light assembly claimed in claim 1 wherein said first lead is of irregular shape.

3. The light assembly claimed in claim 2 additionally including resilient means in said housing to urge at least one of said leads toward contact with a battery in the battery chamber of the housing.

4. The light assembly claimed in claim 1 wherein said housing is comprised of two parts, corresponding surfaces on the housing parts defining a guideway in which the light assembly is slidably carried.

5. The light assembly claimed in claim 1 wherein said insulative means is a disk of non conductive material in surfacial contact with the battery and defining an open area.

6. A light assembly including, a housing, a battery in said housing having planar terminals, a lamp slidably mounted in said housing and including elongate flexible wire leads, said leads oppositely disposed from the disk battery for contact therewith, and insulative means defining an open area therein and supporting one of said leads for generally lengthwise travel of said one of said leads into and out of said open area for contact with a battery terminal.

7. The light assembly claimed in claim 6 wherein said insulative means diverts said one of said leads away from the battery terminal during lengthwise lead travel in one direction.

8. The light assembly claimed in claim 6 additionally including resilient means biasing said one of said leads toward a battery in said housing.

9. The light assembly claimed in claim 8 wherein said one of said leads has an irregular shaped segment for contact with a battery in said housing.

* * * * *